United States Patent [19]

Wannenwetsch

[11] Patent Number: 4,590,904

[45] Date of Patent: May 27, 1986

[54] FUEL INJECTION APPARATUS

[75] Inventor: Peter Wannenwetsch, Stuttgart, Fed. Rep. of Germany

[73] Assignee: Robert Bosch GmbH, Stuttgart, Fed. Rep. of Germany

[21] Appl. No.: 635,021

[22] Filed: Jul. 27, 1984

[30] Foreign Application Priority Data

Aug. 26, 1983 [DE] Fed. Rep. of Germany ..... 3330772

[51] Int. Cl.[4] ..... F02M 45/02; F02M 59/38

[52] U.S. Cl. ..... 123/300; 123/179 L; 123/575; 239/584; 239/93; 417/382

[58] Field of Search ..... 123/299, 300, 179 L, 123/446, 575; 417/382, 245; 239/88–95, 583, 584, 533.3, 112

[56] References Cited

U.S. PATENT DOCUMENTS

| | | | |
|---|---|---|---|
| 2,173,812 | 9/1939 | Bischof | 239/93 |
| 2,173,814 | 9/1939 | Bischof | 239/93 |
| 3,131,866 | 5/1964 | Cummins | 239/584 |
| 3,391,871 | 7/1968 | Fleischer | 123/299 |
| 3,403,861 | 10/1968 | Eichmann et al. | 239/533 |
| 3,627,208 | 12/1971 | Scott | 123/299 |
| 4,108,383 | 8/1978 | Thoma | 239/533.5 |
| 4,289,098 | 9/1981 | Norberg et al. | 123/299 |
| 4,425,885 | 1/1984 | Tanaka | 123/299 |

FOREIGN PATENT DOCUMENTS

| | | | |
|---|---|---|---|
| 3002851 | 7/1981 | Fed. Rep. of Germany | 123/299 |
| 816285 | 8/1937 | France | 123/300 |
| 1235501 | 6/1971 | United Kingdom | 123/300 |

*Primary Examiner*—Carl Stuart Miller

*Attorney, Agent, or Firm*—Edwin E. Greigg

[57] ABSTRACT

A fuel injection apparatus having pre-injection and main injection and associated with Diesel engines is disclosed. A high-pressure injection pump delivers a main injection quantity to a main injection nozzle, and a hydraulic pre-injection auxiliary pump is driven by this same pressure pulse. The pre-injection auxiliary pump includes a stepped piston, comprising a pre-injection piston portion and a driving piston portion, and the stepped piston has as an integral component such as a slide pintle control valve located in an extension of its driving piston portion. This control valve opens the passage to the continuing pressure line and to the main injection nozzle only after a predetermined stroke of the stepped piston has been attained.

1 Claim, 1 Drawing Figure

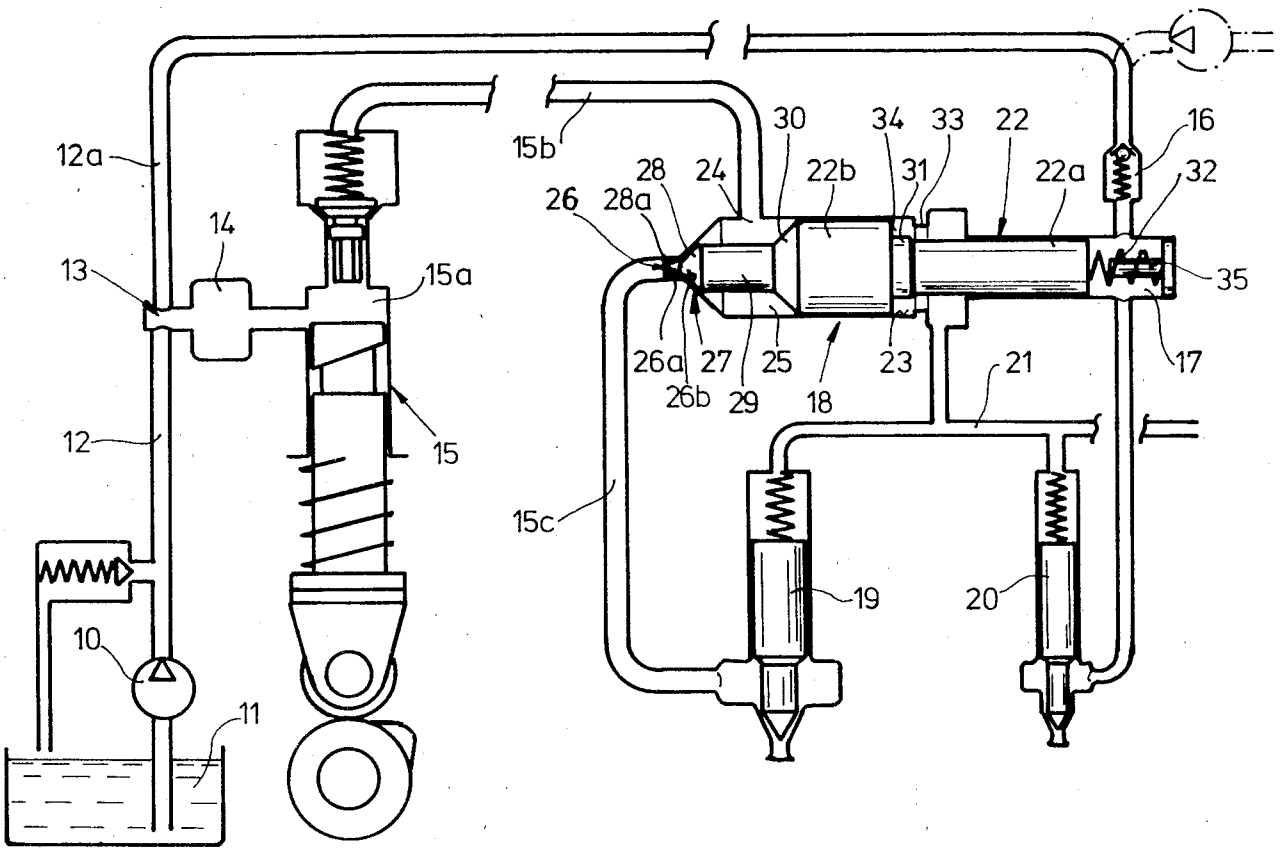
16
32
35
17
22a
22
33
31
34
23
22b
30
24
28
28a
26
26a
26b
27
29
25
18
21
20
19
15b
15c
15a
15
14
12a
13
12
10
11

FUEL INJECTION APPARATUS

BACKGROUND OF THE INVENTION

The invention is based on a fuel injection device for a Diesel engine. In a known fuel injection apparatus of this kind (German Offenlegungsschrift No. 30 02 851), for the sole instance where, on the one hand, a primary fuel that does not ignite readily and is supplied by a high-pressure injection pump and, on the other, an igniting fuel supplied by a separate pump are to be delivered via a hydraulic auxiliary pump to separate injection nozzles for the primary and the igniting fuels in a Diesel engine, it is provided that a pre-injection piston in the auxiliary pump is driven at least indirectly at the supply pressure of the high-pressure injection pump and thereby positively displaces a pre-injection quantity from a work chamber disposed upstream of the work chamber into a separate nozzle for the pre-injection. If the piston in the pressure distributor is embodied as a stepped piston, then the supply pressure of the high-pressure injection pump acts upon the driving piston part, that is, the part having the larger diameter, of the stepped piston, which with corresponding translation mechanically drives the pre-injection piston. Even before the pressure chamber of the driving piston, a branching pressure line leads to the primary injection nozzle. A distribution that is this simple can lead to difficulties in attempting to control the time sequence between pre-injection and main injection accurately, because on the one hand the dead spaces that exist in the connecting lines lead to unavoidable deviations, occurring especially in accordance with load and rpm, from the prespecified control times for the pre-injection and the main injection. At high rpm, for instance, the onset of the pre-injection and the onset of the main injection can take place quite close to one another and in effect combine into a single injection. Means for varying or prespecifying the instant of injection for the pre-injection quantity in an intentional manner are not provided in a timed relationship with the main injection.

It is generally known that undesirable operating noises in Diesel engines are the result of the greater heat developed at the onset of combustion, so efforts have long been made to initiate the combustion by means of a limitable, small pre-injection quantity that can be positioned desirably in terms of time with respect to the main injection, and thereby to limit the combustion speed, or in a general sense to control it. The solution that presents itself in this respect, that is, to dispose two complete, separate injection systems operating parallel to one another is expensive and not recommended, because not only are two pumps, two lines and two nozzles required, but also the necessary means for synchronizing the two systems.

It is also known to attain pre-injection effects by suitable dimensioning of a normal injection system; in that case a specific relationship in terms of size and function must be adhered to for the pre-stroke, diameters of the lines, nozzle ports and nozzle springs, but that leads to a disadvantageous dependency on load and rpm and on the varying dynamic influences during engine operation.

A further known provision is to provide injection pumps with additional control devices, as well as an intermediate reservoir, by means of which the supply speed can be reduced by throttling to the vicinity of zero. In the course of this, an initial stage in the pressure wave traveling to the nozzle can develop, and hence a sort of pre-injection is attainable, at specific rpm and load levels.

Even if the metering and timing of the pre-injection is performed by two systems having two injection pumps, the camshafts of which are coupled together, there are still problems in attaining correct phase orientation between the pre-injection and the main injection as a result of the dependency on rpm and load resulting from the dynamic influence of the two lines.

Still another apparatus is known (German Pat. No. 1 252 001) for attaining a pre-injection and a main injection, in which a separate small piston for the pre-injection is disposed axially offset with respect to a load piston for the main injection inside a fuel injection valve. In this apparatus a separate supply means for low pressure can be dispensed with, and the pre-injection quantity is obtained from the fuel supplied for the main injection, which does not preclude a disadvantageous effect on the standing pressure in the pressure line and thus on the accuracy of quantity control.

Finally, it is also known (German Offenlegungsschrift No. 28 34 633), for controlling the pre-injection in internal combustion engines, to provide a one-piece control slide that is displaceable counter to the force of a spring and that with a pronounced intermediate relief into a reservoir, via control edges, establishes the desired relationships between the pre-injection and the main injection. Here again, the pre-injection is diverted from the injection pump that also furnishes the main injection quantity, so that the accuracy of quantity control for the main injection quantity is disadvantageously affected.

OBJECT AND SUMMARY OF THE INVENTION

The fuel injection apparatus according to the invention has the advantage over the prior art that the pressure line to the main injection line is unblocked only when a predetermined stroke of the pre-injection piston, which may also be part of a stepped piston, has been attained. Since the length of this stroke can be influenced by appropriately varying structural dimensions in the hydraulic pre-injection auxiliary pump, it is possible to prespecify both the instant of the onset of pre-injection and the pre-injection quantity, and finally also the interval between the pre-injection and the main injection, with no rpm dependency being involved. It is a further advantage that the supply pressure built up by the high-pressure injection pump initially serves the purpose of pre-injection exclusively, and therefore no undefined pressure effects in the pre-injection and main injection range need to be reckoned with. Since the inflow of the fuel pumped by the high-pressure injection pump to the structural components that are responsible for the main injection does not take place at all until a predetermined stroke for the pre-injection has been traversed, which stroke can generally also be dimensioned such that the unblocking of the main injection line to the main injection nozzle takes place after pre-injection has been terminated. A high injection speed and a correspondingly high pressure are prought about for the pre-injection itself. The necessity of possibly having to provide a pressure stage [or a step-like change in pressure] during the pre-injection in order to prevent the main injection is thus eliminated entirely.

A particularly advantageous feature of the invention is that the driving piston, which is exposed directly to the supply pressure of the high-pressure injection pump and is part of the stepped piston, is also embodied as a throttling pintle valve, so that the driving piston movement, which simultaneously acts upon the pre-injection piston, determines the operating state of the slide pintle valve.

The invention will be better understood and further objects and advantages thereof will become more apparent from the ensuing detailed description of a preferred embodiment taken in conjunction with the drawing.

BRIEF DESCRIPTION OF THE DRAWING

The single figure of the drawing, in a simplified schematic form, shows the main injection nozzle and the pre-injection nozzle, both of which communicate via short lines to a hydraulic pre-injection auxiliary pump, as well as the connections to a high-pressure injection pump and a low-pressure feed pump.

DESCRIPTION OF THE PREFERRED EMBODIMENT

The basic conception underlying the present invention is to embody the piston of the pre-injection auxiliary pump such that it is part of a throttling pintle control valve, so that the pressure line to the main injection nozzle will only be unblocked, and a graduation of pressure enabled at that instant, once a predetermined stroke of the piston of the hydraulic auxiliary pump has been attained.

The drawing shows a low-pressure feed pump 10, which pumps fuel at a lower pressure than the fuel injection pressure into a first pressure line 12 from a tank 11. Through a line branching off at 13 and an interposed damping reservoir 14, this fuel reaches a pump work chamber 15*a* of a high-pressure injection pump 15. The line 12 connects to a continuing line 12*a* which is provided with a check valve shown at 16 which is connected to the work chamber 17 of a pre-injection hydraulic auxiliary pump for supplying fuel to the hydraulic auxiliary pump which is generally shown at 18. In the drawing, the main injection nozzle is shown at 19 and the pre-injection nozzle at 20; a common return-flow line which also leads from a leakage oil area of the hydraulic auxiliary pump is shown at 21.

Since the design and function of both the low-pressure feed pump 10 and the high-pressure injection pump 15, as well as of the main injection nozzle 19 and the pre-injection nozzle 20, which may be separate elements or else may if desired be combined into one double nozzle, are known per se and are not the subject of the present invention, no further details of these elements will be described herein.

The hydraulic auxiliary pump 18 serving the purpose of pre-injection and of prespecifying a desired injection interval between the pre-injection and the main injection includes at least one piston 22, which is exposed to the supply pressure of the high-pressure injection pump 15. The piston 22 positively displaces a pre-injection quantity out of the work chamber 17 to the pre-injection nozzle 20 and has as an integral component a control valve, preferably a slide pintle control valve 27, which opens the pressure line to the main injection nozzle only upon the attainment of a predetermined stroke of the piston.

In the exemplary embodiment shown in the drawing, the piston 22 is embodied as a stepped piston, or double piston, and includes a driving piston 22*b* of larger diameter as compared with a pre-injection piston 22*a*; these elements 22*a* and 22*b* are supported in a slidably displaceable manner in a stepped bore 23 of the hydraulic auxiliary pump 18. The bore 23 may be disposed in a separate housing, which may then be mounted, in the manner of a separate pressure graduating block, at a suitable location adjacent to or directly on the separate or combined main injection nozzle and pre-injection nozzle.

The pressure inlet from a high-pressure line 15*b* of the high-pressure feed pump 15 is shown at 24; it discharges into a pressure chamber 25, the pressure outlet of which, leading to the main injection nozzle, is shown at 26. The pressure outlet 26, having the shape of a tapered zone 26*b* with an adjoining cylindrical sealing part 26*a* embodies the seat for the control valve 27. While the valve member 28, with a shape that is complementary to the valve seat and with a slide pintle 28*a* which in the exemplary embodiment is cylindrical, is part of a tapered extension 29 of the driving piston, resulting in a transition 30 which in the exemplary embodiment is a conical, annular surface between the extension 29 and the end diameter of the driving piston 22*b*.

Contiguous with the driving piston 22*b*, toward the right in the plane of the drawing, is the pre-injection piston 22*a*, which is moved by a posterior pressure pintle 31 of the driving piston 22*b*. A restoring spring 32 in the work chamber 17 of the pre-injection piston 22*a* keeps this piston 22*a* in contact with the pressur pintle 31.

The following mode of operation results:

The supply pressure generated by the high-pressure injection pump 15, through the pressure line 15*b*, first reaches the hydraulic pre-injection auxiliary pump 18 exclusively and there moves the stepped piston 22, that is, the driving piston 22*b* and the pre-injection piston 22*a*, so that fuel is compressed in the work chamber 17 and positively displaced, at a correspondingly high pressure, to the pre-injection nozzle 20. The stroke of the pre-injection and thus the pre-injection quantity is limited by a stop for the stepped piston 22, which stop may for example be embodied by an inwardly oriented annular flange 33 of the stepped bore 23, against which flange 33 a shoulder 34 of the driving piston 22*b* strikes. While the pre-injection is taking place, a pressure line 15*c* leading to the main injection nozzle 19 is opened by the movement of the driving piston 22*b*, because the slide pintle 28*a* of the valve member 28 has opened the inflow to the continuing pressure line 15*c*, or in other words has emerged from the cylindrical portion of the valve seat 26, no later than the time at which the driving piston 22*b* has reached its stop. The function of the stop embodied by the annular flange 33 may also be performed by a cylindrical piece 35 inside the work chamber 17. The idle volume of the work chamber 17 is thereby reduced, and overstressing of the restoring spring 32 is avoided.

It will be understood, and is within the scope of the present invention, that the pressure line 15*c* to the main injection nozzle 19 can also be opened at some other, earlier time, whenever a predetermined stroke of the stepped piston 22 has been attained. The length of the stroke to be traversed by the stepped piston 22 is then determined by the play that may perhaps be present and by the shape of the pintle in the slide pintle 28*a* that is used. The longer the stroke, from which point on the control valve 27 opens the opening cross section to the pressure line leading on from there, the greater too is the time difference and thus the injection interval between the pre-injection and the main injection. Effects that are dependent on rpm can be attained by providing various kinds of ground surfaces on the originally pressure-tight slide pintle.

Since the line systems for the pre-injection and the main injection are separate from one another in all areas, as shown in the drawing or at any rate can be separated from one another in that a separate low-pressure feed pump 10' shown in dot-dash lines can be used for the continuing pressure line 12*a* and its supply of fuel it will be understood, and is therefore within the scope of the present invention, that the fuel injection apparatus shown can also be used to supply an internal combustion engine with two different types of fuel. That is, in a specialized case, the fuel injection apparatus according to the invention can be used to supply igniting fuel to the pre-injection nozzle and a primary fuel which is difficult to ignite to the main injection nozzle.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection apparatus having pre-injection and main injection in internal combustion engines, comprising a main injection nozzle supplied with a main injection quantity of fuel by a high-pressure injection pump, a hydraulic pre-injection auxiliary pump driven by a supply of fuel under pressure of the high-pressure injection pump, said auxiliary pump includes a stepped piston and a work chamber disposed upstream of said piston, said work chamber being fed by an uninterruptable supply of fuel via a fuel line fitted with check valve means leading from a low-pressure feed pump from which work chamber the pre-injection quantity is positively displaced to a pre-injection nozzle, said stepped piston including a driving piston portion exposed to the pressure of the high-pressure injection pump and a pre-injection piston portion of smaller diameter disposed downstream of the driving piston portion, said driving piston portion including an integral extension forming a stepped valve member of a slide pintle control valve controlled by movement of said stepped piston, said slide pintle control valve being provided with a seat in a pressure outlet of a pressure chamber for said driving piston portion, said driving piston portion being embodied by a tapering, frustoconical transition to a cylindrical sealing part into which said valve member penetrates, said valve member being of complementary embodiment to said seat and having an anterior cylindrical portion associated therewith forming a slide pintle; whereby an inflow of fuel to the main injection nozzle may be blocked until a predetermined piston stroke of said stepped piston is attained and whereby the length and shape of the slide pintle determines the distance between the start of pre-injection and main injection independent of a stop means which limits the total stroke of said stepped piston determining the pre-injection quantity.

* * * * *